US012552592B2

(12) United States Patent
Pfeffer

(10) Patent No.: US 12,552,592 B2
(45) Date of Patent: Feb. 17, 2026

(54) LIQUID DISPENSER

(71) Applicant: Aptar Radolfzell GmbH, Radolfzell (DE)

(72) Inventor: Hubertus Pfeffer, Eigeltingen (DE)

(73) Assignee: Aptar Radolfzell GmbH, Radolfzell (DE)

( * ) Notice: Subject to any disclaimer, the term of this patent is extended or adjusted under 35 U.S.C. 154(b) by 162 days.

(21) Appl. No.: 18/558,609

(22) PCT Filed: May 2, 2022

(86) PCT No.: PCT/EP2022/061736
§ 371 (c)(1),
(2) Date: Nov. 2, 2023

(87) PCT Pub. No.: WO2022/233800
PCT Pub. Date: Nov. 10, 2022

(65) Prior Publication Data

US 2024/0239587 A1 Jul. 18, 2024

(30) Foreign Application Priority Data

May 4, 2021 (EP) ..... 21172087

(51) Int. Cl.
*B65D 81/32* (2006.01)
*A45D 34/04* (2006.01)
*B65D 41/04* (2006.01)

(52) U.S. Cl.
CPC ..... *B65D 81/32* (2013.01); *A45D 34/04* (2013.01); *B65D 41/04* (2013.01);
(Continued)

(58) Field of Classification Search
CPC ..... B65D 81/32; B65D 81/3222; B65D 81/3238; B65D 41/04; A45D 2200/058
See application file for complete search history.

(56) References Cited

U.S. PATENT DOCUMENTS 4,201,316 A 5/1980 Klingaman
4,705,191 A 11/1987 Itzel et al.
(Continued)

FOREIGN PATENT DOCUMENTS

DE 8423325.7 U1 9/1985
EP 0217425 A1 4/1987
(Continued)

OTHER PUBLICATIONS

International Search Report, with English translation, issued in corresponding International Application No. PCT/EP2022/061736, date of mailing Dec. 9, 2022 (10 pages).
(Continued)

*Primary Examiner* — Timothy L Maust
(74) *Attorney, Agent, or Firm* — FLYNN THIEL, P.C.

(57) ABSTRACT

A droplet dispenser for dispensing cosmetic or pharmaceutical liquids in the form of individual droplets, having a medium reservoir with a first and second medium chambers, which are isolated from one another for separately storing two media. The medium chambers are connectable to produce a combined liquid. The droplet dispenser has a discharging opening and, downstream of the discharging opening, a droplet forming contour in order to create droplets which detach from the droplet forming contour as soon as the droplets have reached a defined volume. The droplet dispenser has a pump device between the medium reservoir and the discharging opening, wherein the pump device has a variable-volume pump chamber for delivering combined liquid. The pump device has an inlet valve on the entry side and an outlet valve on the exit side.

20 Claims, 6 Drawing Sheets

(52) U.S. Cl.
CPC .. *A45D 2200/054* (2013.01); *A45D 2200/058* (2013.01); *B65D 2401/00* (2020.05)

(56) References Cited

U.S. PATENT DOCUMENTS

| | | | | |
|---|---|---|---|---|
| 4,832,230 | A | 5/1989 | Janowitz | |
| 5,421,483 | A | 6/1995 | Parise | |
| 5,647,481 | A | 7/1997 | Hundertmark et al. | |
| 5,692,644 | A | 12/1997 | Gueret | |
| 5,811,060 | A | 9/1998 | Laguna Valderrama | |
| 5,908,107 | A | 6/1999 | Baudin | |
| 6,047,818 | A | 4/2000 | Warby et al. | |
| 6,247,586 | B1 | 6/2001 | Herzog et al. | |
| 6,412,659 | B1 | 7/2002 | Kneer | |
| 6,517,878 | B2 * | 2/2003 | Heczko | B65D 85/816 426/115 |
| 6,626,379 | B1 | 9/2003 | Ritsche et al. | |
| 8,701,936 | B2 | 4/2014 | Thomas et al. | |
| 9,434,526 | B2 * | 9/2016 | Son | A45D 34/04 |

FOREIGN PATENT DOCUMENTS

| | | | |
|---|---|---|---|
| EP | 1726532 | A2 | 11/2006 |
| KR | 200416576 | Y1 | 5/2006 |
| WO | 2009020340 | A1 | 2/2009 |
| WO | 2018197187 | A1 | 11/2018 |

OTHER PUBLICATIONS

Written Opinion of International Searching Authority, issued in corresponding International Application No. PCT/EP2022/061736, date of mailing Dec. 9, 2022 (17 pages).

* cited by examiner

LIQUID DISPENSER

FIELD OF APPLICATION AND PRIOR ART

The invention relates to a liquid dispenser for dispensing a liquid, in particular a pharmaceutical or cosmetic liquid. In this respect, the invention relates in particular to a liquid dispenser in the form of a droplet dispenser.

The liquid dispensers to which the invention relates are distinguished in that the liquid to be discharged is not already ready for discharge in an as-supplied state of the dispenser, but rather it is necessary first of all to mix at least two starting media. A liquid dispenser of the type in question therefore has at least two separate media chambers which are connected to one another prior to the discharge, with the result that the at least two starting media can blend with one another and thus form a blended liquid which then subsequently can be discharged.

Problem and Solution

An object of the invention is to provide a liquid dispenser which ensures particularly high homogeneity of the blended liquid and is straightforward and intuitive to handle.

For this, a first aspect of the invention proposes a droplet dispenser for discharging cosmetic or pharmaceutical liquids in the form of individual droplets, the droplet dispenser having a media reservoir with a first media chamber and a second media chamber, which are isolated from one another in an as-supplied state for the separate storage of two media. Two different media, at least one of which is in liquid form, are stored in the media chambers. The second medium may likewise be liquid or else may also be in a liquid-soluble form, in particular as powder or granules.

The media chambers can be connected to one another by the user in order to generate a blended liquid as a result, that is to say a liquid produced by the blending of the two media.

The droplet dispenser has an outlet opening through which the blended liquid can be discharged. This outlet opening is preferably assigned an outlet valve which opens with respect to the surroundings already when there is a small excess pressure in the blended liquid, in particular when there is an excess pressure of no more than 2 bar, preferably when there is an excess pressure of no more than 1 bar. Such opening at low excess pressure is advantageous in order to enable the formation of droplets and to prevent the risk of blended liquid being discharged as a jet of liquid.

The droplet dispenser also has a droplet-forming contour downstream of the outlet opening, in order that the blended liquid can collect there to subsequently be detached from the droplet-forming contour in the form of a droplet. In particular, the droplet-forming contour may have a droplet-forming surface, which surrounds the outlet opening and in particular preferably is delimited on the outside by a separation edge.

In a configuration according to the first aspect of the invention, it is provided that the droplet dispenser has a pump device between the media reservoir and the outlet opening, wherein this pump device has a volumetrically variable pump chamber for conveying blended liquid. The pump chamber has an inlet valve, which opens in the event of negative pressure in the pump chamber, on the inlet side and an outlet valve, which opens in the event of excess pressure in the pump chamber, on the outlet side.

The pump device is designed to convey the liquid already blended beforehand. After the first and the second media chamber are connected to one another, the media they contain blend and thus form the blended liquid. It is usually intended for the user to shake the dispenser after connecting the media chambers to one another, in order to obtain homogeneous blending.

It has been shown that the homogeneity of the liquid can be improved in that the already blended liquid is then conveyed by means of a pump device. In particular if one of the media is present in dry form prior to blending, for example as a powder or granules, the pump device leads to an increase in homogeneity by applying pressure to the blended liquid. It is particularly advantageous if the pump chamber has the inlet and the outlet on the same side of the pump chamber, since this results in a deflection of the flow of liquid, which is conducive to achieving a high degree of homogeneity.

The pump device is preferably designed to convey only a relatively small amount of liquid, preferably less than 100 μl, in particular less than 50 μl, upon actuation of the pump. This reduces the risk of so much liquid being conveyed to the outlet opening owing to excessively forceful actuation that the desired formation of droplets does not take place here.

According to a second aspect of the invention, a liquid dispenser for dispensing cosmetic or pharmaceutical liquids is proposed. In particular preferably, this liquid dispenser is in the form of a droplet dispenser of the type described above.

The liquid dispenser according to the second aspect of the invention has a media reservoir for storing media prior to discharge. In this case, in the manner already described, the media reservoir has a first media chamber and a second media chamber, which are intended to receive different media, in particular to receive two different liquids or else a liquid and a medium in liquid-soluble form, in particular a powder or granules. The media chambers are isolated from one another in an as-supplied state and can be connected to one another to produce a blended liquid. Apart from the direct introduction of powder or granules, there is a further, preferred form for storing a medium in the form of a solid. In this case, the medium is formed by a fine porous solids structure which remains when moisture is removed from liquid that was introduced beforehand and contains the solid before the media chamber is closed.

The liquid dispenser has an outlet opening, through which the blended liquid can be discharged from the media reservoir. As described above, this may be an outlet opening designed to discharge droplets. However, in principle, other configurations of an outlet opening are also possible, for example those that discharge the blended liquid in the form of an atomized spray mist or in the form of an unatomized jet.

Preferably, to convey the liquid from the media reservoir to the outlet opening, in the case of a liquid dispenser according to this second aspect of the invention there is also provision of a pump device having a pump chamber which is provided with an inlet valve on the inlet side and an outlet valve on the outlet side.

According to this second aspect of the invention, it is provided that the media reservoir has a main body which delimits the first media chamber at least in certain portions. The media reservoir also has an inner body, which can be displaced with respect to the main body, delimits the second media chamber at least in certain portions, and is arranged at least in certain portions inside the main body.

The inner body can be displaced with respect to the main body between an isolation position and a connection position. In the isolation position, a connecting channel between the media chambers is closed. This can be achieved in that the inner body has a closure portion, in particular on that end of the inner body that is arranged in the main body, which is arranged in a passage of the connecting channel in the isolation position and is drawn out of this passage as a result of the displacement of the inner body.

To obtain the connection position, the inner body is displaced with respect to the main body by means of a media reservoir thread. Both the main body and the inner body are provided with threads for this, wherein, within the meaning of this invention, a thread is to be understood to mean a structure which can be used to cause a rotational relative movement to directly result in an axial relative movement.

The media reservoir thread makes the operation of connecting the media chambers very easy for the user. For this, all they need to do is perform a relative rotation of the inner body with respect to the main body of the media reservoir. In particular, it can be provided for this that the main body is connected to a housing of the liquid reservoir in one piece or in rotationally fixed fashion, with the result that a relative rotation of the inner body with respect to the housing produces the connection position.

Preferably, the liquid dispenser has a removable cap which protects the outlet opening in the fitted state. If this cap is in the form of a screw cap and is fastened to the housing of the liquid dispenser by means of a cap thread, it is particularly advantageous if the cap thread and the media reservoir thread are in the form of opposing threads. This allows the user to grip both the main body, the housing or the screw cap and the inner body and to rotate them with respect to one another when transferring the media reservoir to the connected state, without this involving the risk that, instead of producing the connected state, only the screw cap is unscrewed and it even possibly going unnoticed that the connected state has been produced.

The inner body delimits the second media chamber at least in certain portions. It preferably forms a wall surrounding the second media chamber. In particular at one end of the second media chamber, this wall has an aperture, with the result that liquid can flow through it toward the first media chamber after axial displacement of the inner body with respect to the main body.

At a preferably opposite end, the inner body is preferably provided with an open end, which can be closed by means of a closure part. The medium can therefore be filled into the second media chamber through this open end while the inner body is already in its isolation position in relation to the main body. After the filling operation, this open end is closed by means of the closure part, wherein in particular preferably the closure part and the inner body are designed to produce a sealing snap-fit connection for this.

The structure of the media reservoir preferably provides that the main body has a sleeve-shaped wall, inside which the second media chamber, delimited by the inner body, is arranged. In this respect, an outer side of the inner body and an inner side of the main body are preferably matched to one another to form a sealing point, such that no liquid can escape into the surroundings here.

The media reservoir thread may be arranged in such a way that it is formed by an internal thread on the main body and an external thread on the inner body.

By contrast, however, a configuration in which an external thread of the media reservoir thread is provided on an outer side of the sleeve-shaped wall of the main body is considered to be advantageous. Correspondingly, the inner body has a sleeve portion, which is arranged outside the sleeve-shaped wall of the main body and on the inner side of which the internal thread of the media reservoir thread is provided.

In such a configuration, the inner body accordingly has two sleeve portions, that is an inner sleeve portion which directly delimits the second media chamber and an outer sleeve portion on which an internal thread is provided. The two sleeve portions are preferably formed in one piece and in particular are connected to one another at a distal end of the inner body.

The outer side of the outer sleeve portion preferably forms a grip surface, where the user can grasp the inner body in order to rotate it. Preferably, this grip surface is provided with a non-round shape and/or surface structuring in order that a user does not slip off it during the rotational movement.

Preferably, a stop which prevents the sub-threads of the media reservoir thread from being completely separated from one another is provided.

Furthermore, it is preferably provided that the media reservoir thread is assigned a latching device, which allows the inner body and the main body to be latched together in the isolation position and/or in the connection position in a manner secured against rotation. This latching device preferably in particular ensures that the media chambers cannot inadvertently return to the isolation position after the connection position is established. Otherwise, there would be the fear that some of the blended liquid cannot be discharged, since it is located in the isolated second media chamber.

In a straightforward configuration, the latching device may be designed such that it fundamentally allows a return to the isolation position, but makes it harder to do so owing to a torque which is, however, increased in certain phases in the course of this. The latching device may, however, also have a return blocking means which mechanically completely prevents a non-destructive return.

Prevention of the return is also expedient, therefore, since it makes it easy for the user to see whether the blending operation has already taken place in a liquid dispenser. If the inner body is in its connection position, the blending has already taken place.

As an alternative or in addition, it is preferably provided that the media reservoir has a tamper-evident portion, which prior to setup of the dispenser is integrally molded on the inner body or on the main body, that is to say in particular is an integral part of the inner body or main body. This tamper-evident portion is then separated from the inner body or from the main body when the media reservoir is transferred to the connection position for the first time. If the tamper-evident portion is missing, or has been visibly separated from the inner body or main body, it is immediately clear to the user that the connection position was present at least in the interim.

The main body of the media reservoir can be fixedly connected to the one-piece or multi-piece housing of the liquid dispenser on which the outlet opening is also provided.

However, it can be advantageous if the main body is in the form of a separate component which is intended for coupling to a housing component, wherein a corresponding coupling device is preferably designed to obtain a rotationally fixed connection and in particular is formed in the manner of a snap-fit coupling.

This formation of the main body as a separate component allows the main body to be connected to the inner body while it is still separate from the housing of the liquid dispenser, to fill the thereby formed and isolated second media chamber with medium, and only then to connect the sub-unit thus formed to the housing of the liquid dispenser.

This offers the advantage that the medium is already isolated in the second media chamber before it comes close to the other medium. Inadvertent blending, for example owing to dripping of a medium at undesired points during the dispensing operation, is thus reliably prevented.

The first media chamber is preferably conjointly formed by walls of the housing of the liquid dispenser and of the main body. Preferably, however, the wall of the housing is already separately able to receive the medium if aligned suitably, in particular if aligned with a downwardly pointing outlet opening, with the result that then the sub-unit mentioned consisting of the main body and the inner body can be fastened to the housing and thereby isolates the first media chamber with respect to the surroundings.

In terms of filling the media chambers of the liquid dispenser or of the droplet dispenser, there are various options depending on the intended use. In particular, it may be provided that both media are in the form of liquids.

However, there are also possible use cases comprised by the invention in which a liquid is stored only in one of the media chambers, while the other media chamber contains a powder or granules soluble in the liquid. If the media reservoir is transferred to the connection state, the liquid dissolves the powder or granules, in particular assisted by a shaking movement and preferably also assisted by subsequent conveyance by means of a pump device resulting in the application of pressure to the already blended liquid.

The use of the dispenser with both a liquid medium and a powder or granules is a consequence primarily of the intended use. Filling one of the media chambers with a powder can, however, generally be advantageous since this makes it possible to prevent the discharge of liquid without prior blending.

This is achieved if the powder or the granules is/are stored in the first media chamber, which has an outlet channel leading to the outlet opening, in particular to a pump device upstream of the outlet opening. In such a configuration, the liquid is stored in the second media chamber.

Therefore, no discharge can take place before the connection position is reached. If the pump device is actuated before the media are blended, it cannot draw liquid into the first media chamber because of the lack of liquid. As a result, it is immediately clear to the user that they have used it incorrectly and that they first of all have to connect the media chambers to one another. If, conversely, the liquid is arranged in the first media chamber and the powder or granules is/are arranged in the second media chamber, there would be the risk that the user only discharges the liquid and at first does not notice the erroneous lack of blending. Even if they later notice the error, they can scarcely correct it, since the establishment of the connection position would result in a blended liquid of which the composition would not correspond to the intended composition owing to the partially already discharged liquid from the first media chamber.

Preferably, it is provided that the media reservoir of the liquid dispenser or droplet dispenser is designed to have its overall volume increased by the connection of the first media chamber to the second media chamber, preferably by at least 1%, preferably by at least 3%. This can be achieved when, during the connection of the media chambers, not only is the partition arranged between them opened, but also at the same time the outer walls outwardly delimiting the media chambers are spaced further apart from one another. A configuration in which the inner body can be moved partially out of the main body by means of the media reservoir thread is in particular advantageous here. The media reservoir has its overall length increased as a result. This at the same time also leads to an increase in the overall volume.

The increase in the volume may constitute an advantage in particular for better blending of the media. Thus, for example, shaking to blend the media is all the more effective the more free space there is available in the connected media reservoir.

Preferably, the droplet dispenser or other liquid dispenser is a side-actuation dispenser. This means that the dispenser has an elongate housing which extends in the direction of a main axis of extent, wherein an actuating pushbutton for actuating a pump device is in the form of a laterally arranged actuating pushbutton which can be radially pressed in for the purpose of actuating the pump device.

Different methods are proposed for mounting and filling a liquid dispenser according to the invention. According to a first method, it is provided that the main body and the inner body are coupled while the main body is still not coupled to a housing of the liquid dispenser. The main body and the inner body thus form a structural unit separate from the housing of the dispenser, the structural unit then already allowing the second media chamber to be filled. Usually, after filling, the second media chamber is also already isolated by fitting the closure part.

Then, this structural unit, comprising the main body and the inner body, is coupled to the housing of the liquid dispenser, wherein preferably the first media chamber on the side of the housing has been filled beforehand.

An alternative method provides that the main body and the inner body are coupled while the main body is already arranged positionally fixedly in relation to a housing of the liquid dispenser, in particular has been coupled to it or is formed in one piece with it. The first media chamber may have been filled beforehand in this case, before the main body has been fastened to the housing. The main body may, however, also be coupled when the first media chamber is already filled, in order that the medium as far as possible picks up no impurities. After the inner body has been mounted on the main body, as a result the second media chamber is also formed and isolated with respect to the first media chamber, with the result that now the second media chamber can be filled.

In both methods, the media chambers can be filled with a solid or a liquid, wherein at least one of the media chambers contains a liquid. A particularly preferred method variant for introducing a solid provides that first of all a liquid is filled into the relevant media chamber. Then, the moisture is removed from this liquid in the still open media chamber, in particular in an oven at a temperature between 60° C. and 110° C. A solid remains in the media chamber, in particular in the form of a fine porous structure. The fine porous structure is very readily soluble in liquid, and therefore the blending can take place very quickly when the liquid dispenser is being set up.

BRIEF DESCRIPTION OF THE DRAWINGS

Further advantages and aspects of the invention will emerge from the claims and from the following description of preferred exemplary embodiments of the invention, which are explained below on the basis of the figures.

DETAILED DESCRIPTION OF THE EXEMPLARY EMBODIMENTS

Figure 1:
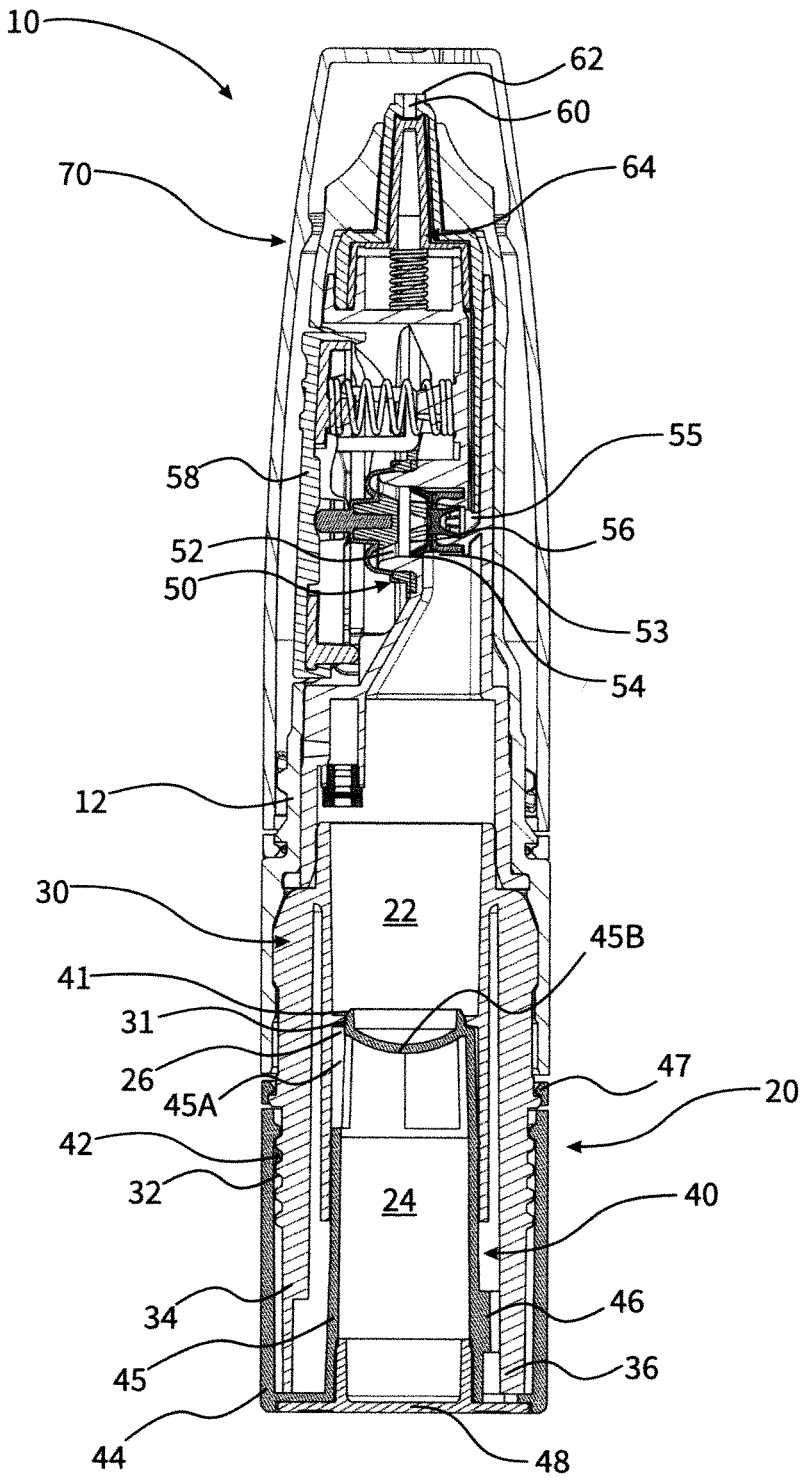
FIG. 1 shows a sectional illustration of a liquid dispenser according to the invention, which is in the form of a droplet dispenser.

FIG. 1 shows a sectional illustration of an exemplary embodiment of a liquid dispenser 10 according to the invention. This liquid dispenser 10 is in the form of a droplet dispenser. Its outlet opening 60 is therefore surrounded by a droplet-forming surface 62. In order to discharge liquid from the media reservoir 20, the liquid dispenser 10 has a pump device 50, which can be actuated by means of an actuating pushbutton 58 mounted on the side of a housing 12 of the liquid dispenser 10. The pump device 50 has a pump chamber 52, the inlet 53 of which is provided with an inlet valve 54 and the outlet 55 of which is provided with an outlet valve 56. The inlet 53 is connected to the media reservoir 20. The outlet 55 is connected to the outlet opening 60, wherein the outlet opening 60 is upstream of an outlet valve 64, which already opens when slight pressure is applied.

If the dispenser is not used, the outlet opening 60 and the actuating pushbutton 58 are covered by a protective cap, which in the present case is in the form of a screw cap 70.

The media reservoir 20 is formed by four components, specifically by the already mentioned housing 12 of the liquid dispenser 10, by a main body 30 fixedly connected, for example snap-fitted, to the housing 12, by an inner body 40 pushed into and in the process screwed onto the main body 30 from a distal end, and by a closure part 48 sealingly pushed into the inner body 40.

These components together form two media chambers 22, 24, which are separate from one another in the as-supplied state of FIG. 1. The first media chamber 22 is primarily delimited by the housing 12 and the main body 30. In relation to the alignment in FIG. 1, the first media chamber 22 is delimited at the lower end by an end portion 45B of the inner body 40. The second media chamber 24 is primarily delimited by an inner sleeve portion 45 of the inner body 40, wherein a plurality of apertures 45A are provided in this sleeve portion 45. In the as-supplied state of FIG. 1, two sealing surfaces 31, 41 of the main body 30 and of the inner body 40 bear against one another, with the result that although medium from the media chamber 24 can pass through the apertures 45A, at first it cannot flow past the sealing point formed by the sealing surfaces 31, 41.

The inner body 40 integrally has, in addition to the inner sleeve portion 45 that primarily delimits the second media chamber, an outer sleeve portion 44, which is on the outer side of the wall 34 around the circumference of the main body 30. This outer sleeve portion 44 ends, at its upper end in FIG. 1, at an integrally molded, annular tamper-evident portion, which in the as-supplied state is connected to the inner body 40 by plastics webs, which are not illustrated in more detail. The outer side of the outer sleeve portion 44 forms a grip surface.

Figure 2:
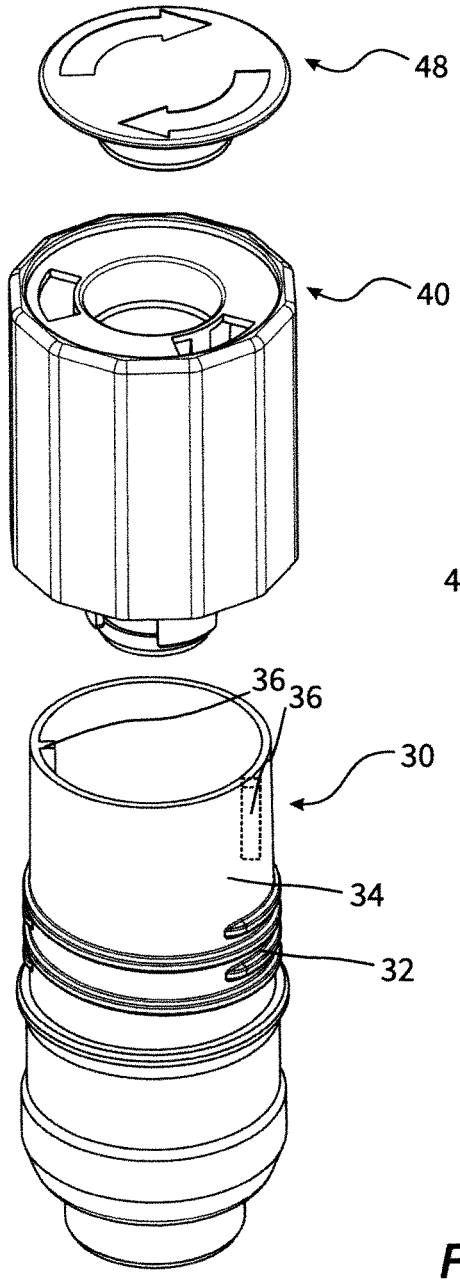
FIGS. 2 and 3 show the individual parts of a media reservoir of the liquid dispenser of FIG. 1.
Figure 3:
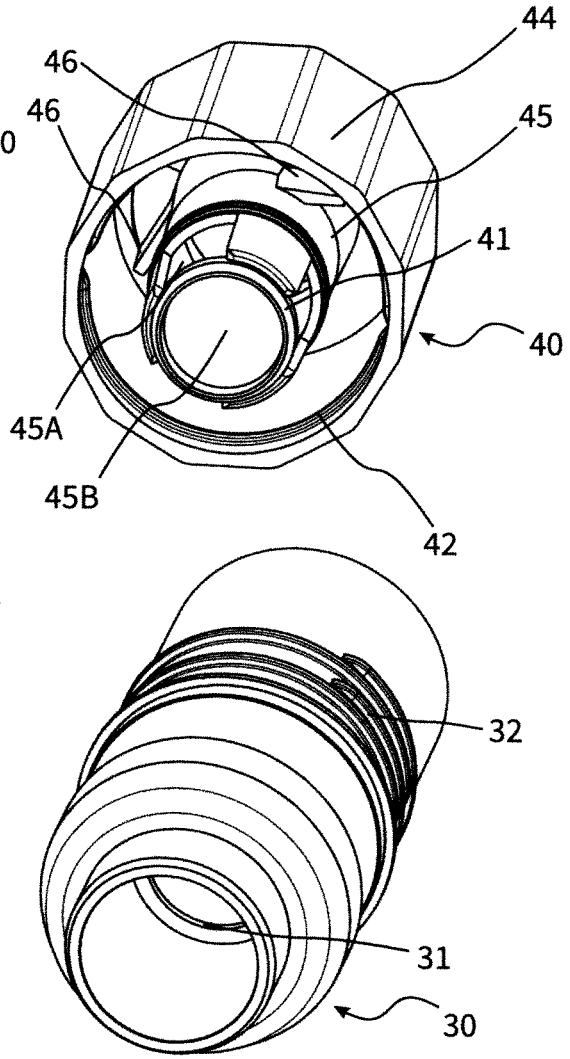

The main body 30, the inner body 40 and the closure part 48 are explained in detail on the basis of FIGS. 2 and 3.

In the manner already described, the main body 30 has a wall 34 around the circumference, on the outer side of which the external thread 32 is provided. On the inner side, the main body 30 has a latching device 36 in the form of a vertical latching web. A sealing web around the circumference, of which the internal terminating surface forms the sealing surface 31, is provided inside the main body 30.

In the manner visible in particular in FIG. 3, the inner body 40 has the already mentioned sleeve portions 44, 45. The inner sleeve portion 45 transitions into the end portion 45B, wherein cutouts forming the already mentioned apertures 45A are provided. Latching arms, which form a latching device 46, are provided on the outer side of the inner sleeve portion 45. The internal thread 42 is provided on the inner side of the outer sleeve portion. Furthermore, the already-described annular tamper-evident portion 47 is mounted on the free end of the sleeve portion 44.

Figures 4A, 4B, 4C:
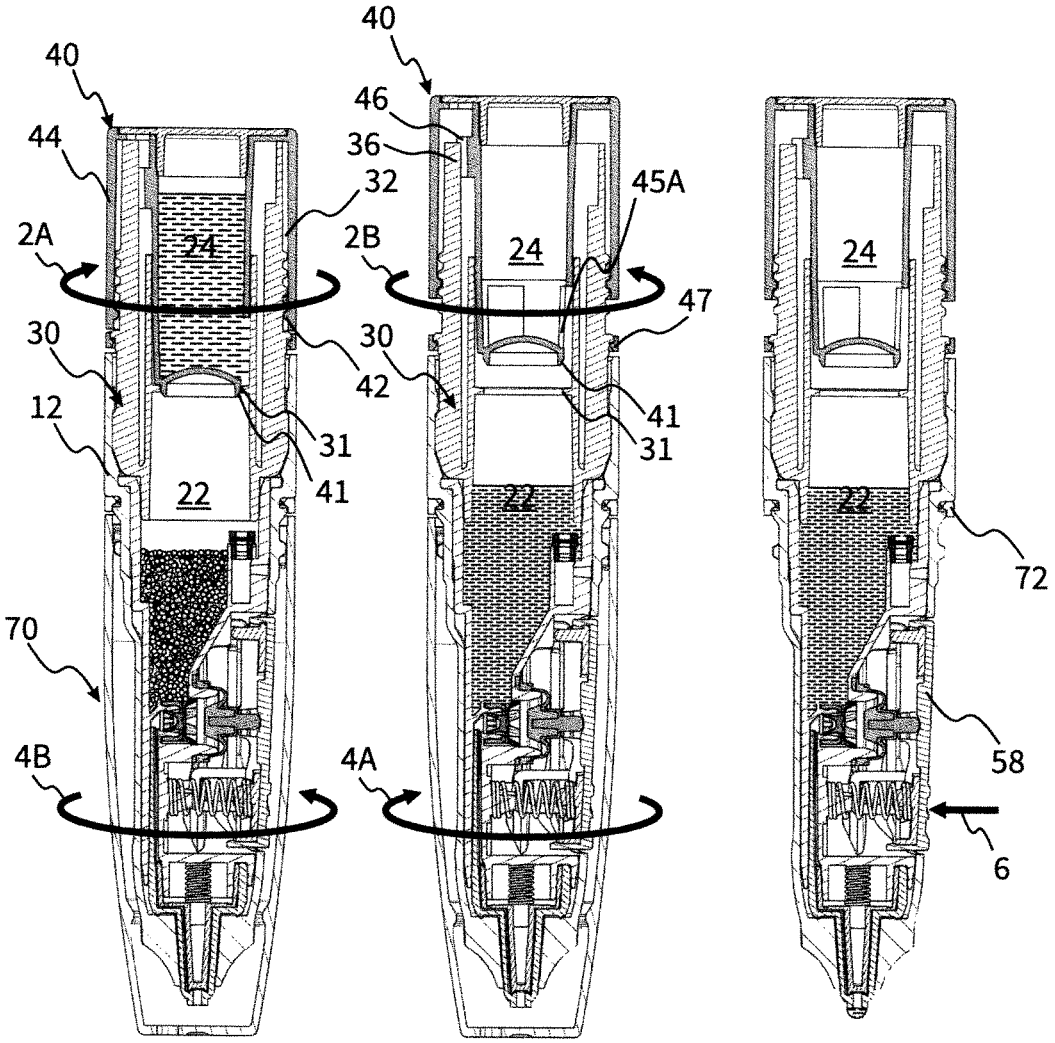
FIGS. 4A to 4C depict the setup of the liquid reservoir of FIG. 1.
Figures 5A, 5B, 5C, 5D:
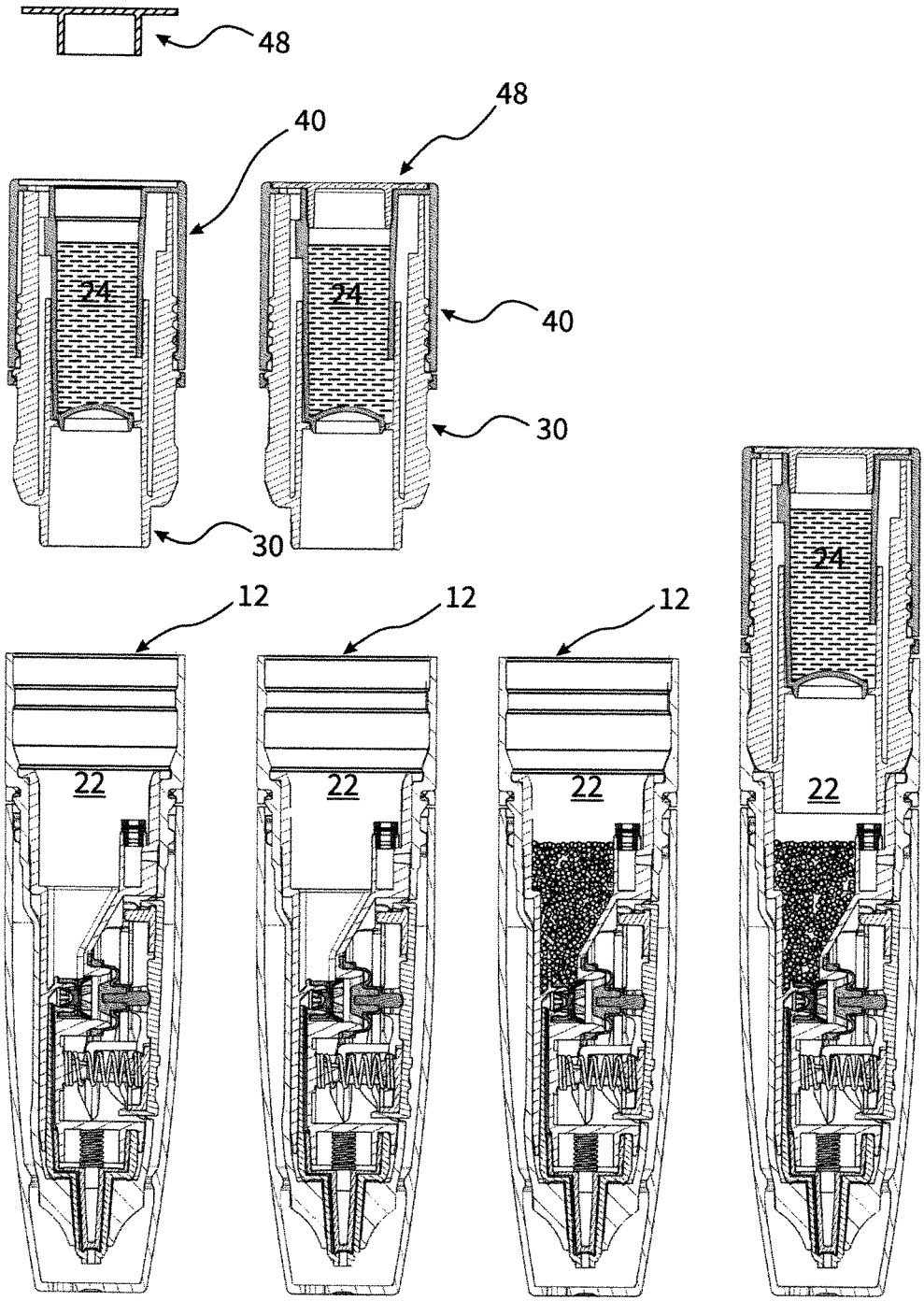
FIGS. 5A to 5D depict a first variant of a mounting and filling operation for the liquid reservoir of FIG. 1.
Figures 6A, 6B, 6C, 6D:
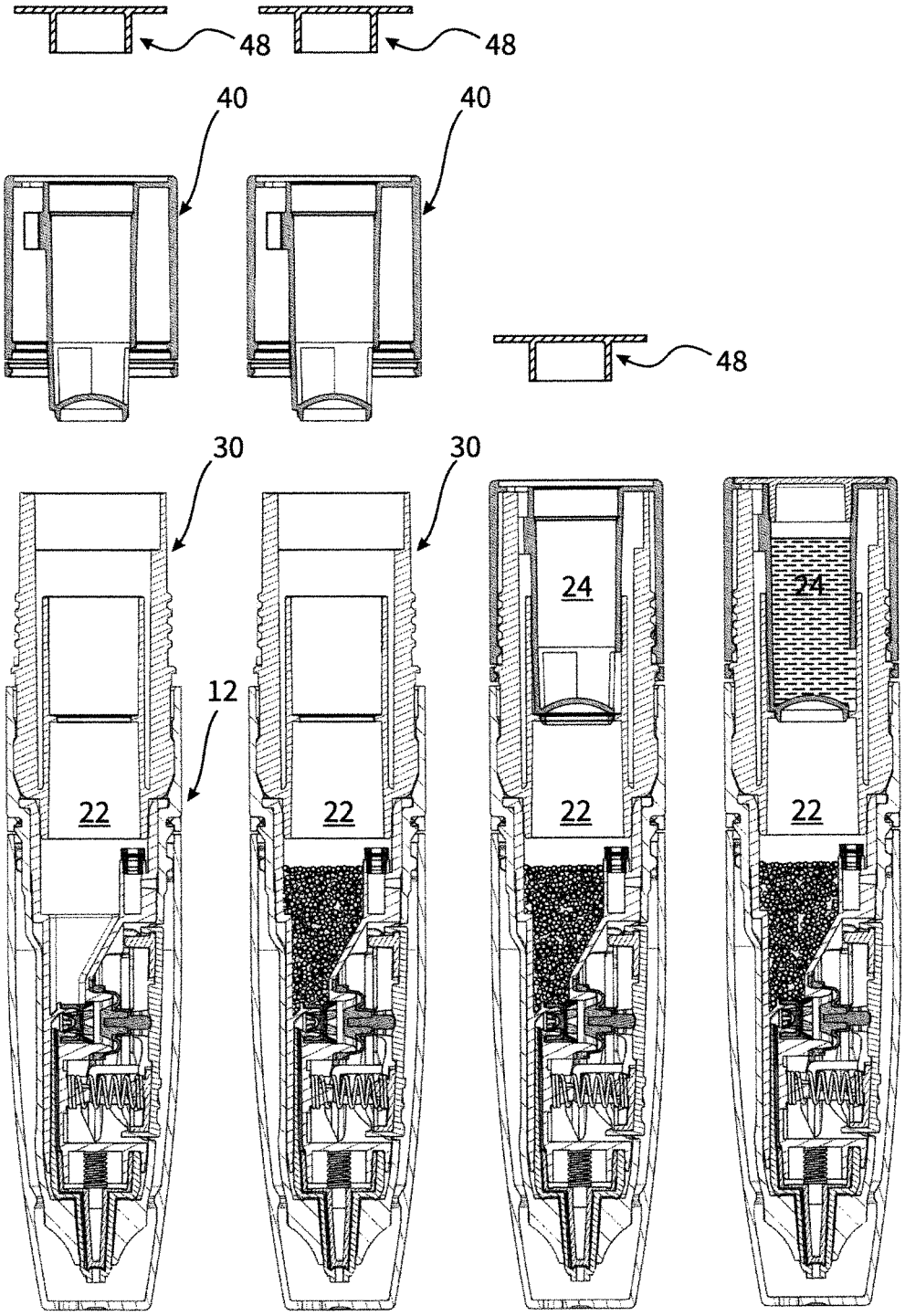
FIGS. 6A to 6D depict a second variant of a mounting and filling operation for the liquid reservoir of FIG. 1.
Figures 7A, 7B, 7C, 7D:
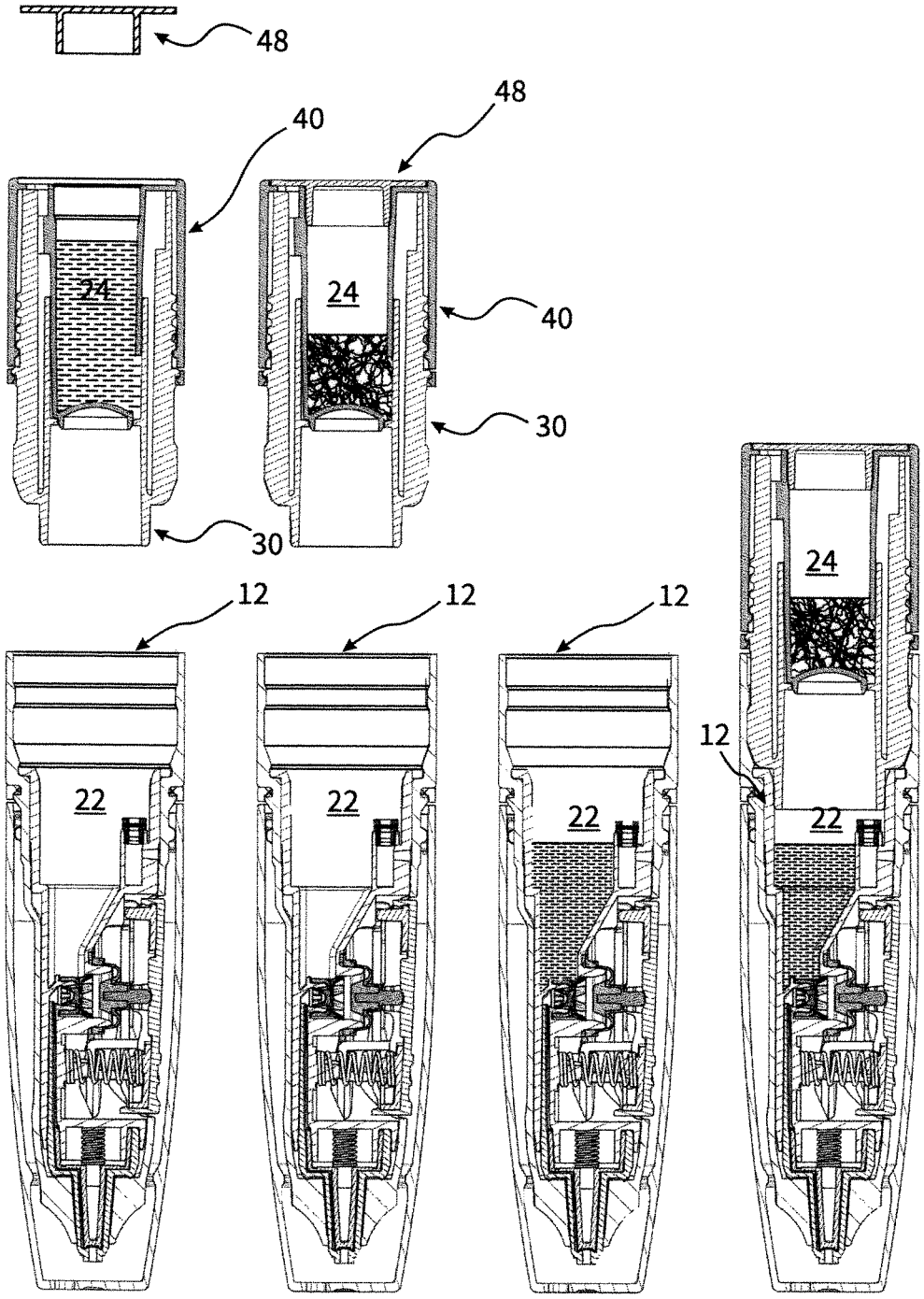
FIGS. 7A to 7D depict a third variant of a mounting and filling operation for the liquid reservoir of FIG. 1.

The procedure for setting up the dispenser is explained on the basis of FIGS. 4A to 4C.

FIG. 4A shows an as-supplied state of the dispenser 10. In this as-supplied state, the media chambers 22, 24 are separated from one another by the sealing points of the sealing surfaces 31, 41, which bear against one another. The inner body 40 is screwed onto the main body 30 as far as an end position by means of the thread 32, 42.

A first medium in the form of granules or a powder is in the first media chamber 22. A liquid medium is in the second media chamber.

To set up the dispenser, it is grasped with two hands, wherein one hand grasps the screw cap 70 and/or the housing 12 while the other hand grasps the grip surface on the outer side of the outer sleeve portion 44 of the inner body 40. If now the screw cap 70 or the housing 12, on the one hand, and the inner body 40, on the other hand, are rotated with respect to one another, as depicted by the arrows 2A, 4B, the sealing point opens and the media chambers 22, 24 are connected to one another. During this operation, there is no risk of instead inadvertently unscrewing the screw cap 70, since the thread of the screw cap 70 and the media reservoir thread 32, 42 run in opposite directions. The rotation of the screw cap 70 in the direction of the arrow 4B thus corresponds to a screwing-on movement of the cap, and not an unscrewing movement.

In the state in FIG. 4*b*, one of the latching arms of the latching device 46 latches to the latching web of the latching device 36 by being drawn irreversibly over this latching web with elastic deformation. This prevents the inner body 40 from rotating back with respect to the main body 30. The second latching arm serves to prevent the complete unscrewing of the inner body 40.

As can be seen in FIG. 4B, the screwing movement of the inner body 40 with respect to the main body 30 causes the annular tamper-evident portion 47 to separate from the rest of the inner body 40, with the result that, in addition to the irreversible axial relative position of the inner body 40 with respect to the main body 30, it is also visible at the separated tamper-evident portion 47 that the connection of the media chambers 22, 24 has already taken place. The liquid medium from the media chamber 24 has already flowed into the first media chamber 22 in the state in FIG. 4B and has blended with the powder there. Usually, it is necessary to shake the dispenser as a whole in order to achieve better blending. The user may also be required to wait a short time until sufficient blending of the media has taken place.

Then, the dispenser is ready for operation, as soon as the screw cap 70 has been unscrewed by a screwing movement in the opposite direction, as depicted by the arrows 2B and 4A. An annular tamper-evident portion 72 remains on the housing 12 here, too.

The dispenser can now be actuated by pressing in the actuating pushbutton 58, with the result that liquid is conveyed to the outlet opening 60 and here forms a droplet on the droplet-forming surface 62. The pump device 50 has its inlet 53 and its outlet on the same side, and therefore the blended liquid is deflected multiple times during the pumping operation. This promotes the homogeneity of the blended liquid.

Even if, during the setup, the transfer of the media reservoir 20 to the connection state beforehand is erroneously forgotten about, and instead the screw cap 70 is directly unscrewed in the wrong direction by application of torque, there is no risk of an erroneous discharge. The pump device 50 is not able, or is able only to a limited extent, to draw the powder that is not blended with liquid into the isolated media chamber 22.

FIGS. 5A to 5D, 6A to 6D and 7A to 7D show three different methods for filling the dispenser in the course of production.

In the case of the method of FIGS. 5A to 5D, starting from an inner body 40 already inserted sealingly in the main body 30, the second media chamber 24 is first of all filled and preferably then closed by means of the closure part 48.

After the first media chamber 22 or that part of the first media chamber that is part of the housing has also been filled, the structural unit consisting of the main body 30, the inner body 40 and preferably the closure part 48 is then connected to the housing 12 by inserting the main body into the housing and latching it there, preferably in a manner secured against rotation.

In the case of this procedure, it is easy to avoid contact between the media during production. The structural unit consisting of the main body 30, the inner body 40 and the closure part 48 can be filled at a separate location. An already isolated second media chamber 24 is fed for mounting with the housing 12.

In the case of the method of FIGS. 6A to 6D, first of all the first media chamber 22 is filled, wherein the main body 30 may already be coupled to the housing 12 in the meantime, although this is not imperative. For this method, the main body may also be formed in one piece with the housing 12.

After the first media chamber 22 has been filled, the inner body 40 is fitted onto the already attached main body 30, with the result that here the first media chamber 22 is isolated with respect to the surroundings and the second media chamber 24. Then, the second media chamber 24 is filled, and closed by means of the closure part 48.

In the case of the method of FIGS. 7A to 7D, in a similar way to the method of FIGS. 5A to 5D, first of all the second media chamber 24 is filled starting from an inner body 40 already inserted sealingly in the main body 30. The filling is effected with a liquid in the manner illustrated in FIG. 7A. Before the media chamber is closed by means of the closure part 48, the moisture is removed from the liquid, in particular by heating the sub-unit consisting of the main body 30 and the inner body 40 to over 60° in an oven over several hours. The porous solids structure illustrated in FIG. 7B remains. Only after the moisture has been removed is the closure part 48 fitted and the media chamber 24 isolated as a result.

In the case of this method, a liquid is filled into the first media chamber 22. Then, the sub-unit consisting of the main body 30 and the inner body 40 is inserted into the housing.

Although in the case of the method of FIGS. 7A to 7D a media reservoir 20 with two media chambers 22 and 24 which can be coupled by a thread is provided, according to a particular configuration according to the invention it may also be provided that filling with liquid that is evaporated prior to closing is also provided in the case of liquid dispensers with a pump device, in particular in the case of droplet dispensers of which the media chambers 22 and 24 can be coupled to one another in another way, for example by removing a closure part from a connecting channel between the media chambers.

The invention claimed is:

1. A droplet dispenser for dispensing cosmetic or pharmaceutical liquids in the form of individual droplets, the droplet dispenser comprising:

a media reservoir with a first media chamber and a second media chamber, the first and second media chambers being isolated from one another for separately storing two media, the first and second media chambers being connectable to one another for producing a blended liquid;

an outlet opening;

a droplet-forming contour downstream of the outlet opening; and a pump device between the media reservoir and the outlet opening, the pump device having a volumetrically variable pump chamber for conveying blended liquid, the pump chamber having an inlet valve on an inlet side and an outlet valve on an outlet side;

wherein the pump device is configured to convey an amount of liquid of at most 100 μl upon full actuation.

2. The droplet dispenser as claimed in claim 1, comprising at least one of:

the droplet dispenser has an outlet valve upstream of the outlet opening and configured to open at a liquid excess pressure of at most 1 bar.

3. The droplet dispenser as claimed in claim 1, further comprising a housing and a removable screw cap protecting the outlet opening in a fitted state, the screw cap being fastened to the housing by a cap thread, the cap thread and the media reservoir thread being in the form of opposing threads.

4. The droplet dispenser as claimed in claim 1, further comprising a closure part and an inner body, the inner body having an open end closable by the closure part.

5. The droplet dispenser as claimed in claim 1, further comprising a main body delimiting the first media chamber, an inner body displaceable with respect to the main body and delimiting the second media chamber, the inner body being displaceable with respect to the main body between an isolation position and a connection position, and a connecting channel, the connecting channel being between the media chambers and being closed in the isolation position and the connecting channel being open in the connection position, the inner body being displaceable with respect to the main body by a media reservoir thread for transferring from the isolation position to the connection position, the main body having a sleeve-shaped wall, the second media chamber being arranged in the sleeve-shaped wall, the media reservoir thread having an external thread provided on an outer side of the sleeve-shaped wall, the inner body having a sleeve portion arranged outside the sleeve-shaped wall of the main body, the sleeve portion having an inner side, and the media reservoir thread having an internal thread provided on the inner side.

6. The droplet dispenser as claimed in claim 5, further comprising a latching device, associated with the media reservoir thread, the latching device allowing the inner body and the main body to be latched together in the connection position in a manner secured against rotation.

7. The droplet dispenser as claimed in claim 5, wherein the media reservoir has a tamper-evident portion, the tamper-evident portion, prior to operation, being integrally molded on the inner body or on the main body and being separated from the inner body or the main body upon transfer to the connection position.

8. The droplet dispenser as claimed in claim 5, wherein the droplet dispenser has a housing and the outlet opening is provided on the housing, the first media chamber is delimited by the main body and the housing, and the main body is in the form of a component separate from the housing such that the main body is couplable to the housing when the housing is filled with medium.

9. The droplet dispenser as claimed in claim 1, wherein respective liquids are stored in the first and second media chambers.

10. The droplet dispenser as claimed in claim 1, wherein a liquid is stored in one of the first or second media chambers and a powder or granules is/are stored in the other first or second media chamber.

11. The droplet dispenser as claimed in claim 10, wherein the powder or the granules is/are stored in the first media chamber and the liquid is stored in the second media chamber, and the droplet dispenser further includes an outlet channel leading to the outlet opening and being connected to the first media chamber such that the liquid can only be discharged if the liquid was transferred from the second media chamber to the first media chamber beforehand.

12. The droplet dispenser as claimed in claim 4, wherein the closure part and the inner body are connected as a snap-fit connection.

13. The droplet dispenser as claimed in claim 5, wherein the inner body is movable partially out of the main body by the media reservoir thread to increase an overall volume of the media reservoir.

14. The droplet dispenser as claimed in claim 1, wherein the media reservoir is configured such that an overall volume thereof is increased by connection of the first media chamber to the second media chamber.

15. The droplet dispenser as claimed in claim 1, further including an elongate housing extending in a direction of a main axis of extent, and an actuating pushbutton for actuating the pump device, the actuating pushbutton comprising a laterally arranged actuating pushbutton, the laterally arranged actuating pushbutton being pressable radially inwardly for actuating the pump device.

16. A method for producing a droplet dispenser as claimed in claim 5, including coupling the main body and the inner body such that the main body and the inner body are in the isolation position while the main body is not yet coupled to a housing of the liquid dispenser.

17. The method for producing a droplet dispenser as claimed in claim 5, including coupling the main body and the inner body while the main body is arranged in a positionally fixed fashion in relation to a housing of the liquid dispenser.

18. The method for producing a droplet dispenser as claimed in claim 16, further including filling one of the media chambers with a liquid, and removing moisture from the liquid before the one media chamber is closed such that only a solid that was present in the liquid beforehand remains.

19. The method for producing a droplet dispenser as claimed in claim 16, including:

filling the first media chamber before a structural unit comprising the main body and the inner body is coupled to a housing of the liquid dispenser; and/or filling the second media chamber before a structural unit comprising the main body and the inner body is coupled to a housing of the liquid dispenser.

20. The method producing a droplet dispenser as claimed in claim 17, further including filling the first media chamber before or after the main body is fastened to the housing.

* * * * *